United States Patent [19]

Frangel

[11] Patent Number: 4,862,643

[45] Date of Patent: Sep. 5, 1989

[54] PORTABLE FINISHING MACHINE APPARATUS

[76] Inventor: William L. Frangel, 2012 Jenner La., St. Louis, Mo. 63138

[21] Appl. No.: 157,845

[22] Filed: Feb. 19, 1988

[51] Int. Cl.[4] ..... B24B 3/36

[52] U.S. Cl. ..... 51/58; 51/173; 51/238 T

[58] Field of Search ..... 51/58, 60, 57, 210–211, 51/170 MT, 173, 285 R, 119, 120, 109 BS, 125, 59, 238 T, 238 S; 76/82, 82.2, 81.7, DIG. 9

[56] References Cited

U.S. PATENT DOCUMENTS

| | | | |
|---|---|---|---|
| 1,294,616 | 2/1919 | Carlson | 51/211 R |
| 2,412,141 | 12/1946 | Ford | 51/119 |
| 3,844,067 | 10/1974 | Guerra et al. | 51/58 |
| 3,875,702 | 4/1975 | Yacos | 51/58 |
| 4,627,194 | 12/1986 | Friel | 51/170 MT |
| 4,768,309 | 9/1988 | Miller | 51/285 |

FOREIGN PATENT DOCUMENTS

| | | | |
|---|---|---|---|
| 0240603 | 10/1925 | United Kingdom | 51/6 |

*Primary Examiner*—Robert Rose

*Attorney, Agent, or Firm*—Polster, Polster and Lucchesi

[57] ABSTRACT

A hand portable finishing machine apparatus including an open-ended housing member sized to be manually portable from one location to another, the housing having a power means disposed therein mechanically linked to a finishing block support table releasably supporting a finishing block thereon, the table being moveable in a preselected orbital path relative the housing for finishing an article on the finishing block.

10 Claims, 4 Drawing Sheets

PORTABLE FINISHING MACHINE APPARATUS

BACKGROUND OF THE INVENTION

The present invention relates to the article finishing machine art and more particularly to a novel, portable article finishing machine apparatus which can be readily moved manually from one location to another.

Power driven machinery for moving an article finishing and/or restoring block, such as an abrasive grinding stone, in a preselected manner to grind, sharpen or to otherwise finish or restore selected articles has long been known in the article finishing and restoring arts. In this regard, attention is directed to long since and more recently expired U.S. Pat. Nos. 2,320,376, issued to E. Mueller on June 1, 1943; 2,412,141, issued to A. J. Ford on December 3, 1946; 3,063,204, issued to J. G. Baumgartner on November 13, 1962; and, 3,277,610, issued to R G. Mazur on October 11, 1966. These patents, as well as other patents noted in the article finishing and restoring art, teach comparatively complex, large and cumbersome, stationary structures for finishing or restoring various types of tools and other selected articles. However, none of these structures of the prior art have recognized or provided an arrangement which could be mass manufactured and assembled in a straightforward, efficient and economical fashion, producing an article finishing machine apparatus which can be manually portable for efficient commercial and domestic usage.

The present invention, recognizing the need for a power operated article finishing machine apparatus for finishing or restoring finished articles—such as knives and scissors, wood carving tools, cold chisels, and planing blades—provides a unique, manually portable finishing machine which can be readily manufactured and assembled in mass quantities on an economical basis for both commercial and domestic use. The unique hand portable finishing machine apparatus of the present invention can be simply operated by one person with comparatively minimum risk and requires a minimum of storage space when not in use. In addition, the present invention provides a unique and novel structural arrangement which permits ready and efficient removal of a finishing block for finishing surface changes to finish, sharpen, clean, sand and/or polish various selected articles and which allows for protective cover of the finishing block in the assembled machine when not in use. Further, the present invention provides a unique article support arrangement which is readily adjustable to enhance accurate article finishing operations.

Various other features of the present invention will become obvious to one skilled in the art upon reading the disclosure set forth herein.

BRIEF SUMMARY OF THE INVENTION

More particularly, the present invention provides a hand portable finishing machine apparatus comprising: an open-ended housing member sized to be manually portable from one location to another; power means disposed within the housing member, the power means including a rotatable drive shaft extending therefrom; table means having inner and outer faces moveably supported adjacent to the open end of the open-ended housing member with the inner face in covering relation with the open end, the table means having means to releasably support and retain an article finishing block on the outer face thereof; an article finishing block releasably mounted on the outer face of the moveable table; and, mechanical drive linkage means extending between and connecting the drive shaft to the moveable table to provide movement of the table with the article finishing block releasably mounted thereon in a preselected orbital path relative to the housing to permit finishing of a preselected article on the finishing block. In addition, the present invention provides a novel article support structure which can be readily adjusted and employed to enhance efficient article finishing and/or restoring.

It is to be understood that various changes can be made by one skilled in the art in one or more of the several parts of the apparatus disclosed herein without departing from the scope or spirit of the present invention.

BRIEF DESCRIPTION OF THE DRAWINGS

Referring to the drawings, which disclose one advantageous embodiment of the present invention and a modification thereto.

DETAILED DESCRIPTION OF THE INVENTION

Figure 1:
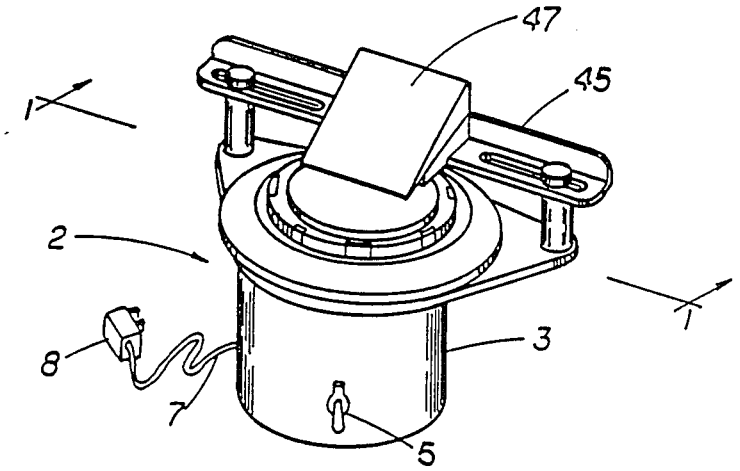
FIG. 1 is a perspective view of an assembled inventive portable finishing machine apparatus taken from a position above the inventive apparatus.
Figure 2:
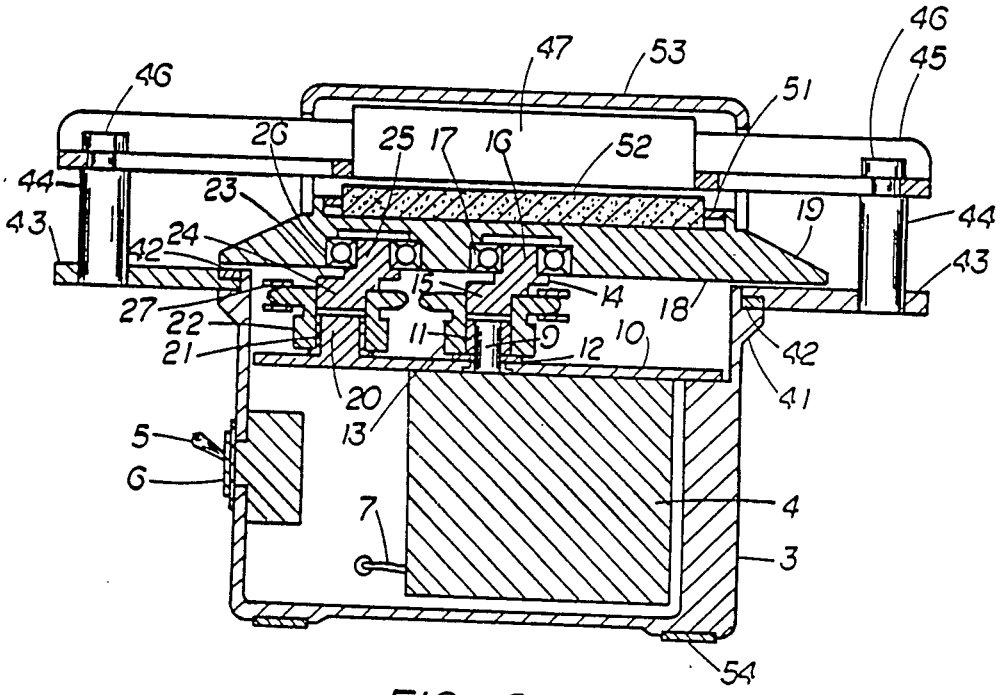
FIGS. 2, 3 and 4 are enlarged cross-sectional views of the apparatus of FIG. 1, each taken in a plane through or similar to line 1—1 of FIG. 1 with each disclosing an individualized mechanical drive linkage arrangement.
Figure 5:
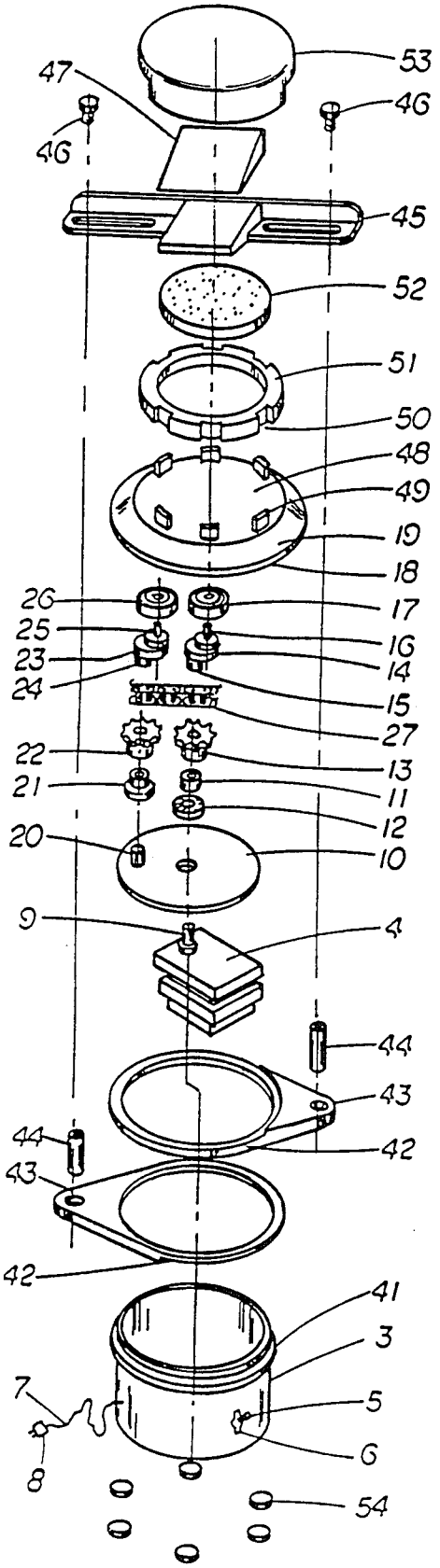
FIG. 5 is a reduced exploded perspective view of the apparatus of FIGS. 1 and 2.

Referring to FIGS. 1, 2 and 5 of the drawings, one advantageous embodiment of the inventive hand portable finishing machine apparatus, broadly referred to by reference numeral 2, is disclosed. Machine 2 includes an open-ended housing member 3, which advantageously can be of cylindrical cup-shape, formed from a suitable light, strong plastic or metallic material. Housing 3 is sized to be manually and conveniently portable by one person from one location to another, making the machine suitable for both commercial and domestic use.

A suitable power source, advantageously in the form of a small, lightweight, appropriately sized electric gear head motor 4 is disposed within housing 3. Motor 4 can be connected to an "on-off" control switch 5 mounted in the wall of housing 3, secured by nut 6, with its power wire 7 extending through the wall of housing 3 for connection to a suitable wall outlet power source by means of electrical plug 8. Details of the wiring connections for motor 4 are not disclosed since any one of several types of known conventional wiring arrangements can be employed. Motor 4 also includes a rotatable drive shaft 9 vertically extending therefrom through an aperture in main support plate 10 mounted to and extending transversely across housing 3. Surroundingly mounted on drive shaft 9, through suitable bushing 11, supported by thrust bearing 12, is drive sprocket 13. Sprocket 13 is arranged to receive and mechanically connect drive shaft 9 of motor 4 with eccentric hub 14. The lower portion 15 of hub 14 nests with a central opening in sprocket 13 to be fixed thereto in vertical and axial alignment with drive shaft 9. The sprocket 13, mechanically connected to drive shaft 9, drives chain 27 which, in turn, drives sprocket 23, as described further below. The upper portion 16 of hub 14 is eccentrically offset from the lower portion 15 to engage in bearing 17 set in an opening in the inner face 18 of a disc-shaped support table 19 moveably supported adjacent to the open end of housing 3 to cover such housing.

Support table 19 receives further support through an auxiliary member adapted to permit movement of the table in a preselected orbital path concomitant with support thereof. In the embodiment of FIGS. 2 and 5 of the drawings, this auxiliary support includes a hub 20 projecting vertically from main plate 10 and having a bushing 21 fitted thereon rotatably surrounded thereby by driven sprocket 22. Driven sprocket 22 has an eccentric hub 23; the lower portion 24 of eccentric hub 23 nests with a central opening in driven sprocket 22 to be fixed thereto in vertical alignment with hub 20. The upper portion 25 of hub 23 is eccentrically offset from the lower portion 24 to engage in bearing 26 set in a second opening in the inner face 18 of table 19 spaced from the opening accommodating bearing 17. It is to be noted that the offset eccentricity of driven hub 23, which is driven through chain 27 connecting drive sprocket 13 with driven sprocket 22, corresponds with the offset eccentricity of drive hub 14 so as to permit movement of table 19 in the preselected orbital path concomitant with further table support therefor.

Figure 3:
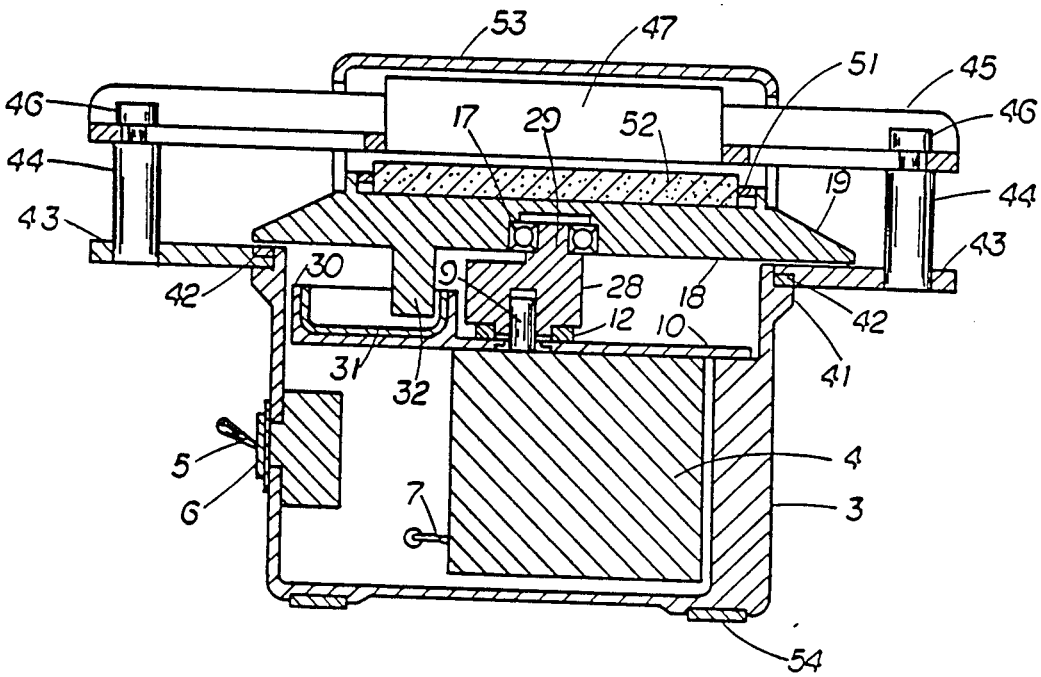
Figure 6:
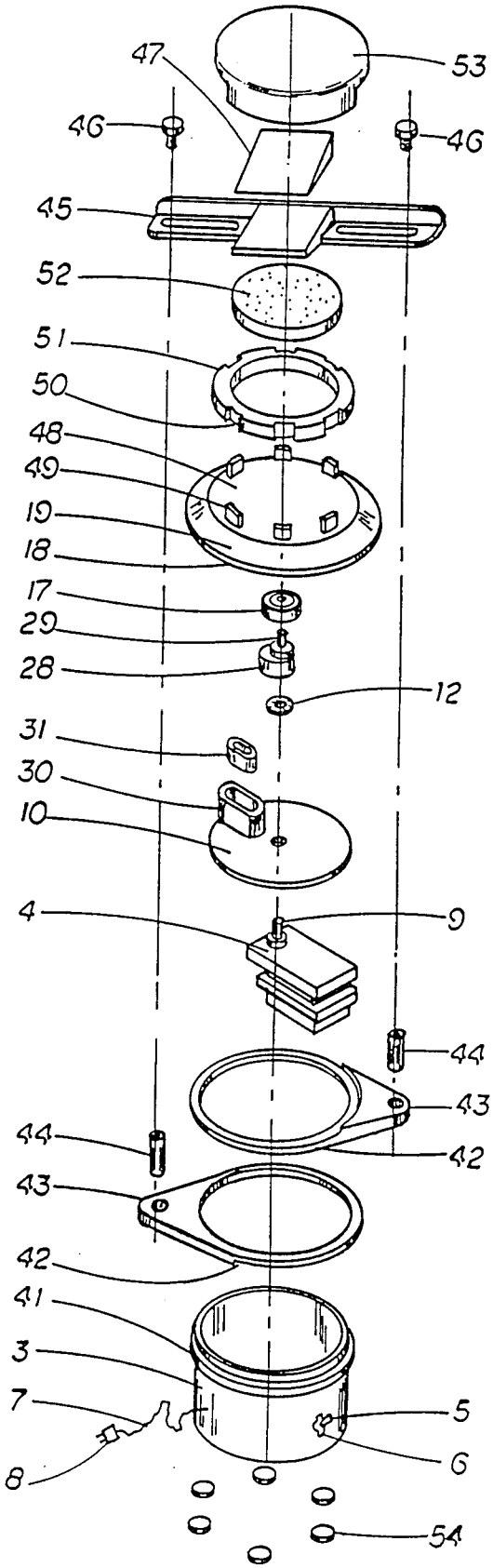
FIG. 6 is a reduced exploded perspective view of the apparatus of FIGS. 1 and 3; and, FIG. 7 is a reduced exploded perspective view of the apparatus of FIGS. 1 and 4.

Referring to FIGS. 3 and 6 of the drawings, a modified mechanical drive linkage arrangement is disclosed. Surroundingly mounted on drive shaft 9, supported by a suitable thrust bearing 12 on main support plate 10, is drive hub 28. Hub 28 is arranged to receive and is mechanically connected to drive shaft 9 of motor 4. The upper portion 29 of hub 28, which is in eccentrically offset relation to drive shaft 9, engages into bearing 17 set in an opening in the inner face 18 of a disc-shaped support table 19 moveably supported adjacent to the open end of housing 3 to cover such housing. Additionally, the main support plate 10 includes a track guide member 30 and liner 31. A pin follower 32 (FIG. 3) assembly is mounted to and extends between table 19 and into liner 31 on main support plate 10. Track guide 30 and liner 31 are sized and shaped to control the orbital path of support table 19 created by eccentric hub 29 to permit movement of table 19 in the preselected orbit concomitant with further table support therefor.

Figure 4:
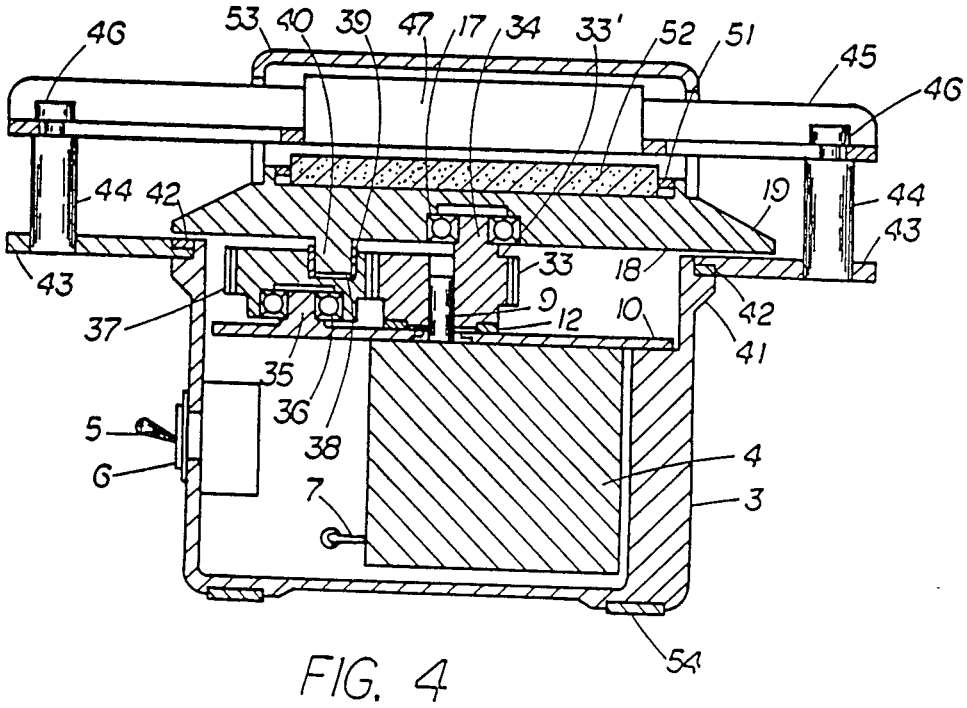
Figure 7:
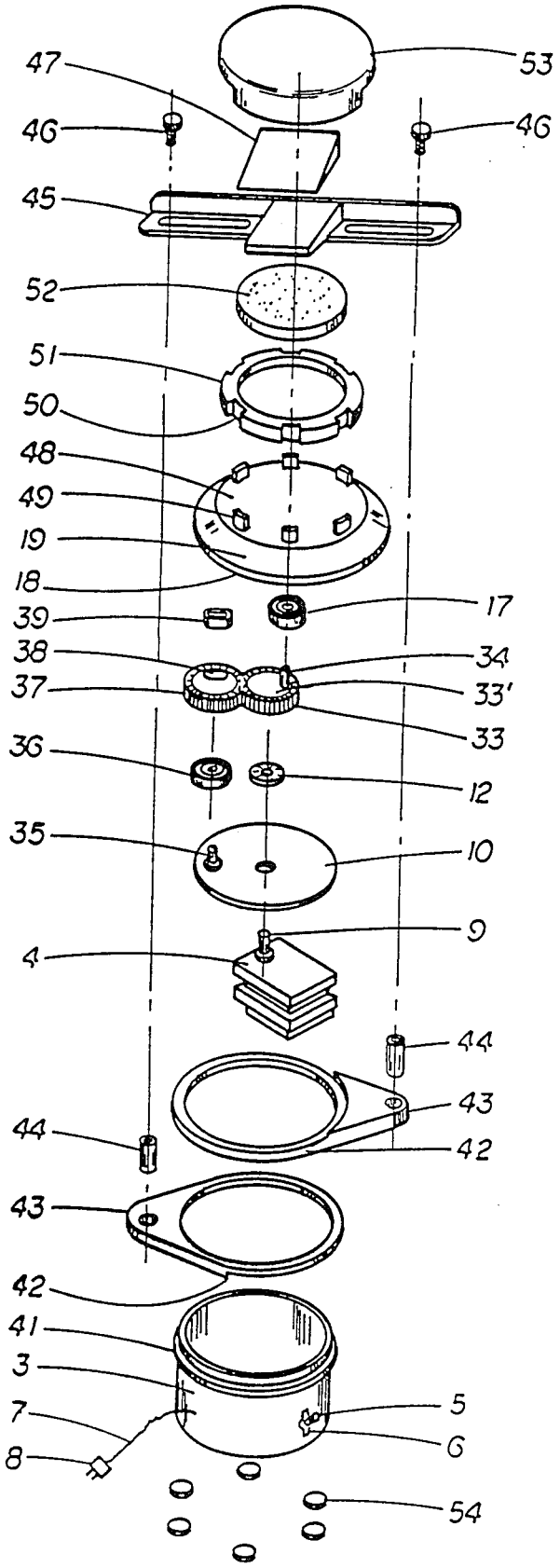

Referring to FIGS. 4 and 7 of the drawings, a second modified mechanical drive linkage arrangement is disclosed. Surroundingly mounted to drive shaft 9 supported by a suitable thrust bearing 12 on main support plate 10 is drive gear 33. Drive gear 33 is arranged to receive and is mechanically connected to drive shaft 9 of motor 4. The upper portion 33' of drive gear 33 includes a hub 34 projecting vertically, in eccentrically offset relation to drive shaft 9. Hub 34 is engaged into bearing 17. Bearing 17 sets in an opening in the inner face 18 of the disc-shaped support table 19 moveably supported adjacent to the open end of housing 3 to cover such housing. Additionally, the main support plate 10 includes a hub 35 surrounded with a bearing 36. Bearing 36 is engaged into driven gear 37, which contains a track guide 38 and liner insert 39 in the top surface of driven gear 37. A pin follower 40 (FIG. 4) assembly is mounted to and extends between table 19 and into liner 39. The track guide 38 and liner insert 39 are shaped to control the orbital path of support table 19 created by eccentric drive gear pin 34 to permit movement of table in pre-selected orbit concomitant with further table support therefor.

Referring particularly to FIGS. 1 through 5 of the drawings, it can be seen that housing 3 is provided with an article support assembly to extend above table 19 and a finishing block (to be described hereinafter) for supporting one surface of an article to be finished by the finishing block, such as one surface of a cutting or planing tool while the opposite surface is being sharpened by an abrasive finishing block. As disclosed, the article support assembly includes a protruding ledge 41 surrounding the periphery of housing 3 adjacent the open end thereof. Arranged to rest on ledge 41 in stacked rotatably adjustable relation are a pair of peripheral rims 42 which are sized and shaped accordingly and which advantageously each includes an ear portion 43 to provide a pair of spaced cantilevered apertured, relatively adjustable ear portions 43. The apertures of ear portions 43 each receives one end of one of a pair of adjustable spaced support posts 44 with the free ends of support posts 44 extending above support table 19 and the finishing block mounted thereon. A suitable guide track 45 is mounted on the free ends of posts 44 and secured by post ends 46. The guide track 45 is of appropriate length and breadth to permit slidable movement on the free ends of the posts 44 therein when rims 42 and posts 44 mounted thereon are adjusted relative to each other. A suitable support platform 47 can be adjusted angularly on guide track 45. Accordingly, by sliding and adjusting rims 42 and posts 44, track 45 and platform 47 thereon can be adjustably positioned relative to support table 19.

As can be seen in FIGS. 5, 6 and 7 of the drawings, the outer face 48 of support table 19 is provided with a plurality of resilient fingers 49 extending upwardly from outer face 48 in spaced relation around the periphery of the flat portion thereof, the outer surface 48 of table 19 tapering downwardly and outwardly from the flat portion toward the periphery of the inner face 18 of table 19. Fingers 49 are sized to firmly nest in interlocking relation with spaced grooves 50 of block retainer rim 51 to releasably grip and retain a preselected finishing block 52 to be mounted on the flat portion of the outer surface 48 of table 19. Finishing block 52 which can be formed from any one of a number of suitable materials, depending upon the preselected usage thereof, advantageously can be provided with opposed faces of preselected different finishing qualities. For example, if knife sharpening is contemplated, one surface of block 52 can be of a comparatively rough abrasive quality and the other of a fine or polishing abrasive quality.

To protect the exposed surface of block 52 when machine 2 is not in use, a finishing block cover cap 53 can be provided. Cap 53, which advantageously can be made of a suitable, thin plastic or metallic material, is provided with a peripheral rim sized and adapted to snap fit with grooved rim 51 and nesting fingers 49 to appropriately cover block 52, support platform 47 and a portion of guide track 45.

Finally, it is to be noted that to prevent housing 3 from skidding, a suitable number of rubber anti-skid pads 54 can be fastened to the bottom face of housing 3.

From the above, it can be seen that a unique and novel hand portable finishing machine arrangement is provided which can be readily and economically manufactured and assembled on a mass basis, permitting ready substitution of parts and easy non-slip handling for a variety of uses with a minimum of risk in both commercial and domestic environments.

The invention claimed is:

1. A hand portable finishing machine apparatus comprising:

an open-ended housing member sized to be manually portable from one location to another;

power means disposed within said housing member, said power means including a rotatable drive shaft extending therefrom;

an orbitally movable table means having inner and outer faces movably supported immediately adjacent to the open end of said open-ended housing member with the inner face in covering relation with said open end, said table means having means to releasably support and retain an article finishing block on the outer face thereof;

an article finishing block releasably mounted on the outer face of said moveable table means;

mechanical drive linkage means fully disposed in said open-ended housing member and extending between and connecting said drive shaft to said orbitally movable table means to provide support for and movement of said table means with said article finishing block releasably mounted thereon in a preselected orbital path relative said housing to permit finishing of a selected article on said finishing block;

an adjustable article support means including a protruding ledge surrounding the periphery of said housing member adjacent the open end thereof;

a peripheral rim member sized and shaped to adjustably rest on said protruding ledge, said peripheral rim member having at least one apertured cantilevered ear portion to receive one end of an article support post; and, an article support post having one end fixed in said apertured cantilevered ear portion of said peripheral rim member with another end thereof extending above and adjacent said finishing block to adjustably support one end of an article to be finished.

2. The portable article finishing machine apparatus of claim 1, said mechanical drive linkage means extending between and connecting said drive shaft to said orbitally moveable table means including a drive member connected to said rotatable drive shaft and eccentric connecting means extending in offset relation to said drive shaft to connect said drive member to said orbitally moveable table to provide support for and oscillatory movement of said table means in said preselected orbital path.

3. The portable article finishing machine apparatus of claim 1, said mechanical drive linkage means extending between and connecting said drive shaft to said orbitally moveable table means including a drive member connected to said rotatable drive shaft, said drive member having an eccentrically mounted hub extending therefrom in offset relation to said drive shaft;

said orbitally moveable table means having bearing means disposed therein to receive said eccentrically mounted hub for support for and oscillatory movement of said table means in said preselected orbital path.

4. The portable article finishing machine apparatus of claim 1, further comprising auxiliary table support means extending in spaced relation to said mechanical drive linkage means, said auxiliary table support means being adapted to provide auxiliary support for and permit movement of said table means in said preselected orbital path concomitant with the auxiliary support thereof.

5. The portable article finishing machine apparatus of claim 1, said mechanical drive linkage means extending between and connecting said drive shaft to said orbitally moveable table means including a drive sprocket member connected to said rotatable drive shaft and a first eccentric connecting hub means extending in offset relation to said drive shaft to connect to said orbitally moveable table means to provide support for and oscillatory movement of said table means in said preselected orbital path; and, auxiliary table support means extending in spaced relation to said mechanical linkage means, said auxiliary table support means including a driven sprocket member connected to said drive sprocket of said mechanical drive linkage and a second eccentric connecting driven hub member extending from said driven sprocket member in corresponding offset relation with said first eccentric connecting means to connect said driven hub member with said table means to provide auxiliary support for and permit movement of said table means in said preselected orbital path concomitant with such further auxiliary support thereof.

6. A hand portable finishing machine apparatus comprising:

an open-ended housing member sized to be manually portable from one location to another;

power means disposed within said housing member, said power means including a rotatable drive shaft extending therefrom;

an orbitally movable table means having inner and outer faces movably supported immediately adjacent to the open end of said open-ended housing member with the inner face in covering relation with said open end, said table means having means to releasably support and retain an article finishing block on the outer face thereof;

an article finishing block releasably mounted on the outer face of said moveable table means;

mechanical drive linkage means fully disposed in said open-ended housing member and extending between and connecting said drive shaft to said orbitally movable table means to provide support for and movement of said table means with said article finishing block releasably mounted thereon in a preselected orbital path relative to said housing member to permit finishing of a selected article on said finishing block;

an article support means including a protruding ledge surrounding the periphery of said housing member adjacent the open end thereof;

a pair of peripheral rim members sized and shaped to adjustably rest in stacked relation on said protruding ledge, said peripheral rim members each having spaced apertured cantilevered ear portions to receive corresponding ends of spaced article support posts;

at least two spaced article support posts, each having corresponding ends fixed in one of said apertured cantilevered ear portions with one free end extending above said finishing block;

a guide track slidably mounted between said free ends of said spaced article support posts for adjustment relative to said finishing block; and, an angularly adjustable platform mounted on said guide track to support one end of an article to be finished.

7. The portable article finishing machine apparatus of claim 6 wherein said finishing block has opposed faces of preselected differing finishing qualities.

8. The portable article finishing machine apparatus of claim 7 wherein said power means comprises a small electric gear head motor.

9. The portable article finishing machine apparatus of claim 8 said block support means on said table means to releasably support and retain a finishing block thereon including a plurality of spaced finger members projecting upwardly from said outer face of said table means; and a grooved peripheral finishing block retainer rim adapted to firmly nest in interlocking relation with said spaced finger members to releasably grip and retain said finishing block disposed therein.

10. The portable article finishing machine apparatus of claim 9, and a finishing block cover cap having peripheral rim sized and adapted to snap fit with said grooved retainer rim and spaced finger members of said table means.

* * * * *